US005105642A

United States Patent [19]

Mohr

[11] Patent Number: 5,105,642

[45] Date of Patent: Apr. 21, 1992

[54] CONTINUOUS COIL SPRING FORMING METHOD

[75] Inventor: Henry G. Mohr, Carthage, Mo.

[73] Assignee: L&P Property Management Company, Chicago, Ill.

[21] Appl. No.: 560,371

[22] Filed: Jul. 30, 1990

[51] Int. Cl.[5] ..... B21F 35/02; B21F 21/00

[52] U.S. Cl. ..... 72/137; 140/3 CA; 140/92.4

[58] Field of Search ..... 140/3 CA, 92.94, 92.4, 140/103; 72/137, 146, 138, 133

[56] References Cited

U.S. PATENT DOCUMENTS 3,188,845 6/1965 Gerstorfer ..... 72/138
4,726,106 2/1988 Mohr ..... 140/3 CA

FOREIGN PATENT DOCUMENTS 0154838 6/1989 Japan ..... 140/924
1377775 12/1974 United Kingdom ..... 72/138

*Primary Examiner*—Lowell A. Larson
*Assistant Examiner*—Michael J. McKeon
*Attorney, Agent, or Firm*—Wood, Herron & Evans

[57] ABSTRACT

Multiple coil springs, particularly springs of alternating right and left hand coils, are formed from a continuous wire, interconnected by spring heads formed of straight lengths of the wire, by a coiler having a stationary forming head which with a pair forming rollers which bend the wire to one side or the other, with the formed coils extending in the same direction from the forming head, thus producing a partially formed step-shaped spring. The partially formed spring is passed through a spin tube which damps out the alternating twists resulting from the coiling procedure. Downstream from the coiler, the partially formed spring is folded by imposing opposite 180° twists to consecutive pairs of the interconnecting heads to reverse the direction of alternate ones of the coils.

13 Claims, 5 Drawing Sheets

CONTINUOUS COIL SPRING FORMING METHOD

The present invention relates to the manufacture of coil springs, particularly continuous multiple coil springs, and, more particularly, to the manufacture of multiple coil spring assemblies having coils of alternating direction or hand.

BACKGROUND OF THE INVENTION

Machines for forming coil springs from continuous wire are well known in the prior art. In the manufacture of mattresses and upholstered furniture that use arrays of coil springs, machines have been employed in the prior art that form a plurality of springs from a continuous length of wire. One such machine is disclosed in British Patent No. 937,644 to Willi Gerstorfer entitled "Improvements in or relating to Machines for the Manufacture of Compression Spring Strips from Wire, for example for Upholstery Inserts." The machine of the Gerstorfer patent is operative to manufacture from a continuous length of wire a plurality of interconnected compression springs comprising alternate left and right hand coil springs joined by an integral straight length of wire. The machine of the Gerstorfer patent employs a coil forming device having moveable linkages to shift the settings of the machine to coil the continuous wire. The Gerstorfer machine is particularly useful in forming from continuous wire a multiple coil spring having coils of alternating direction or hand. To form such springs, the Gerstorfer machine coils the wire alternately in first one direction and then the other, with each coiling direction being followed by the feeding of a length of straight wire, which forms an interconnecting head between adjacent coils.

As coil springs are manufactured from a continuous strand of wire, a continuous spring with interconnected coils is formed. As this continuous spring moves downstream from the coil forming device, it acquires a torsional build-up that increases as the formed wire spirals away from the coil forming device and moves toward a take-up reel. If the coiling of the formed spring is entirely or predominantly in one direction, accumulated torsion or a twisting is produced downstream of the coil forming device that must be relieved. To accommodate this potential accumulated torsional build-up the Gerstorfer machine oscillates the forming device over 180° so that the imparted twist is in first one direction and then the other. As a result, the accumulated twist or torsion in the formed multiple coil spring is that of, at most, the number of turns of one coil. In the Gerstorfer machine, the formed spring also exits the forming device in one direction regardless of the direction of the formed coil.

Such oscillation of the forming devices has the disadvantage of limiting the speed at which the forming device can operate. It also produces an undesirable flipping of the formed spring from one side to the other at the exit of the forming device, which flipping produces a high centrifugal force on the spring that must be controlled. As a result, spring forming machines that employ the coiling devices and forming methods such as those of the Gerstorfer patent are insufficiently fast to supply an assembly apparatus. Typically, six to eight coil forming machines may be required to supply one assembly apparatus. Thus, the spring must be coiled and then later supplied to an assembling apparatus, and then loaded on the assembler in a time consuming process. Furthermore, defects in a spring may not be discovered until an entire defective reel is formed and later proves unusable when assembly is attempted.

By utilizing a Gerstorfer type coil forming machine in such a way as to eliminate the need to oscillate the forming device, it has been found that significant increases may be made in the speed at which the forming machine can operate. One such approach is, for example, disclosed in the commonly assigned Adams, et al. U.S. Pat. No. 4,112,726. The method and apparatus of the Adams et al. patent, produces, from a continuous coil spring, multiple coil spring assemblies by forming intermittent spring heads at intervals along a preformed continuous single coil spring, and then bending the coils to face first one direction and then the other. The springs so formed, however, are all of the same rotational direction or hand and, accordingly, must be linked by diagonally oriented heads. Such springs require very complex machinery to form and assemble the springs into assemblies.

Accordingly, there is a need in the spring manufacturing art to provide for the manufacture from continuous wire of spring assemblies, particularly those having coils of alternating hand or rotational direction which can be achieved rapidly, particularly without the need to oscillate the coil forming device.

SUMMARY OF THE INVENTION

It is a primary objective of the present invention to provide a coil forming method and apparatus for rapidly manufacturing spring assemblies from continuous wire. It is a particular objective of the present invention to provide such a method and apparatus for producing springs having coils of alternating hand or rotational direction which can be achieved rapidly. It is a more particular objective of the present invention to provide a method and apparatus for manufacturing such a spring without the need to oscillate the coil forming device or excessively flip the spring downstream of the forming device.

In accordance with the principles of the present invention, there is provided a method of forming and assembling a multiple coil spring with a coiling device which may remain facing in one direction. The method provides for the manufacture of such a spring having coils of both right and left hand rotation. The coils of the springs so formed extend away from each interconnecting spring head on opposite sides of the head as a partially formed spring is produced by the coil forming device. In a subsequent step, the coils of the partially formed spring are alternately bent or folded 180° about the interconnecting spring heads downstream of the forming device. This subsequent folding of the partially formed spring results in a spring formed of a continuous wire with coils, preferably of alternating rotation, alternately extending in opposite directions, with their axes parallel and disposed in a substantially common plane.

According to the preferred embodiment of the present invention, the coils formed by the coiling device are preferably coiled in alternating directions and spaced along the continuous wire separated by heads formed of straight of otherwise shaped lengths of the continuous wire. The coils so produced are fed downstream from the coil forming device with all of the coils, regardless of rotational direction, extending parallel to each other and in the same downstream inclined direction, thus producing a stairstep or zig-zag shaped partially formed spring. Then, downstream of the coiling device, the straight lengths of wire which form the interconnecting spring heads are twisted 180° so that the direction of each coil is reversed with respect to the adjacent coils, thereby producing a spring in which the coils emerge parallel to each other, face in alternately opposing directions, and lie in the substantially same plane.

The apparatus for folding the springs 180° according to one embodiment of the present invention includes a coil forming device or so called coiler into which wire is fed in a single direction. The coiler includes a mechanism, which preferably includes a pair of wire bending dies or rollers spaced on opposite sides of the wire, to alternately bend the wire to coil it in one direction or the other. The coiler has a fixed orientation and includes a mechanism to bend the wire, preferably perpendicular to the wire feed and coil bending directions, to impart pitch to the coils all in the same direction regardless of the coil rotation direction.

The apparatus further includes, according to one embodiment of the present invention, a spin tube positioned around the partially formed spring which leaves the coil forming device to contain the alternating twisting motion of the spring to damp out this motion before the spring reaches further forming equipment downstream of the coiler.

The apparatus further provides, according to a preferred embodiment of the invention, two pair of plier like wire grippers, each of which grip both ends of opposite ones of the two spring heads on opposite sides of a coil and reverse the direction of the coil with respect to the adjacent and preferably opposite handed coils, while simultaneously imparting permanent opposite 180° twists to the spring head portions held between the grippers of each pair.

The present invention provides the advantage of forming a multiple coil spring, which may include coils of alternating rotational direction, without the accumulation of twist or torsion to the continuous wire of the formed spring. The present invention provides this advantage without the need to employ a coil forming device which oscillates to oppositely facing positions in order to avoid the accumulated twist of the wire and alternate flipping of a large length of formed spring about a wide radius. As a result, the inertial and centrifugal forces of the coil forming device and formed spring are reduced, providing the capability of a considerable increase in the coil production speed. As a consequence, the number of coil forming devices needed to supply a single spring assembly apparatus is reduced.

These and other objectives and advantages of the present invention will be more readily apparent from the following detailed description of the drawings in which:

DETAILED DESCRIPTION OF THE DRAWINGS

Figure 1:
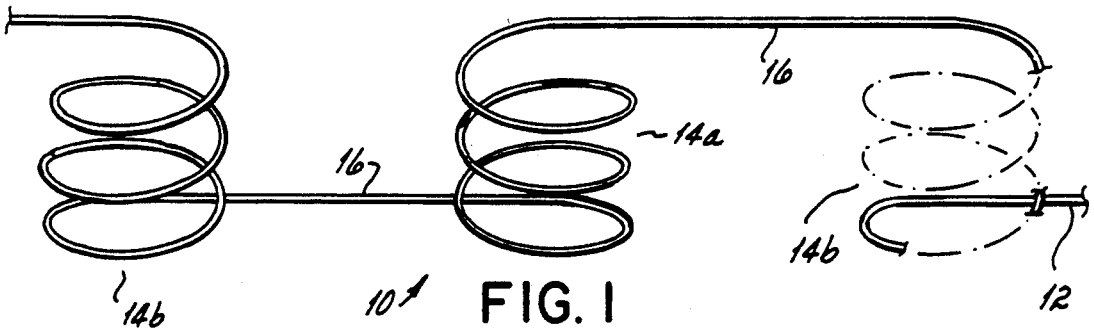
FIG. 1 is an isometric view of an example of a coil spring formed by a coil forming apparatus.

FIG. 1 illustrates a coil spring 10, which is one example of the type of spring that is particularly suited for manufacture on apparatus of the type to which the present invention relates. The spring 10 is formed of a continuous length of wire 12 into a series of coils 14 that include alternating left and right hand coils, such as left hand coil 14*a* and right hand coil 14*b*, interconnected by straight sections 16 of the wire 12.

In the prior art, springs such as spring of FIG. 1 have been manufactured on machines like those described in the Gerstorfer British patent No. 937,664. Such a machine is represented diagrammatically in FIG. 2.

Figure 2:
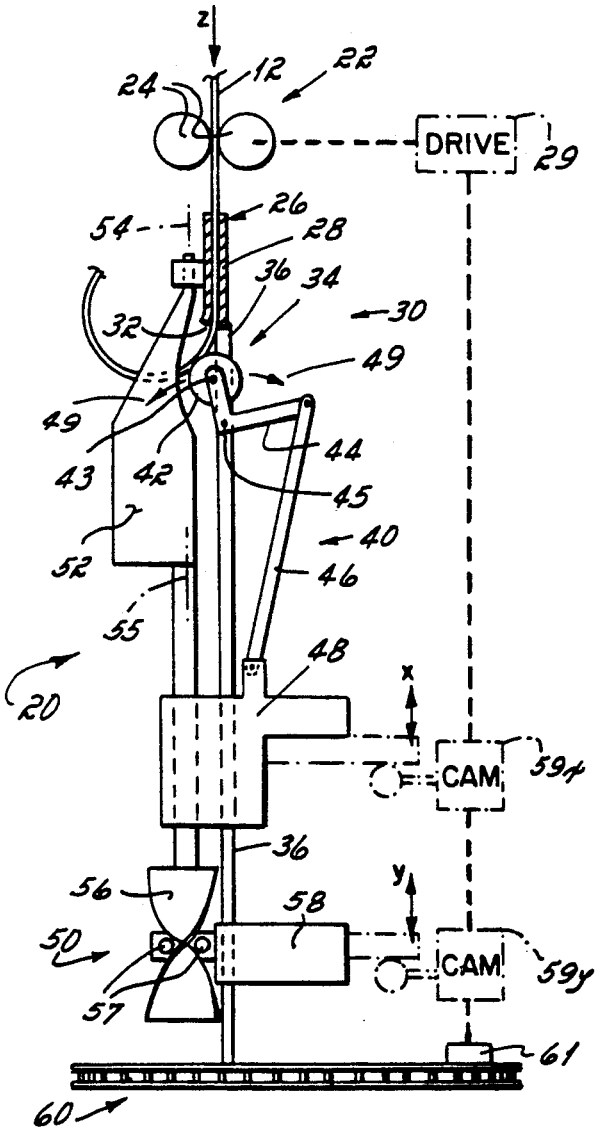
PRIOR ART FIG. 2
FIG. 2 is a diagrammatic drawing of a coil forming apparatus of the prior art.

Referring to FIG. 2, a spring coil forming apparatus or coiler 20, according to the prior art, is provided with a wire feed mechanism 22, which includes a pair of feed rollers 24 to advance the wire 12 longitudinally in a linear direction z through a channel 26 formed in a wire guide 28 of a forming device or coiling device 30. The wire 12 emerges from the channel 26 of the forming device 30 at an orifice 32 where it is shaped into the form of the spring 10 by a spring forming mechanism 34, which bends the wire 12 to deform plastically and thereby permanently shape it to that of the desired spring design, as for example the design of the spring 10 of FIG. 1.

The spring forming mechanism 34 is mounted on a shaft 36, which is rigidly attached to the guide 28 of the forming device 30. The shaft 36 and the forming device 30 are rotatable on a frame (not shown), as described in the Gerstorfer patent. Accordingly, the shaft 36, for purposes of the present invention, may be considered fixed.

The forming mechanism 34 includes a coiling radius forming section 40, which bends the wire 12 into an arc lying in the transverse plane of the coils 14 of the spring 10 and a coil pitch forming section 50, which bends the wire 12 in a direction axial to the coils 14 of the spring 10.

The coil forming section 40 includes a forming roll 42 having a groove in the edge thereof to guide the wire 12 as it emerges from the orifice 32 of the device 30 and deflects the wire 12 in the plane of the roll 42. The roll 42 is rotatably mounted about an axis 43 perpendicular to the plane of the roll 42 on an L-shaped lever 44. The lever 44 is in turn pivotally mounted at the angle of the L, to the shaft 36 to pivot about an axis 45 parallel to the axis 43. The end of one leg of the L-shaped lever 44 is pivotally linked to one end of a rod 46. The rod 46 is pivotally linked at its other end to a block 48, which is slidably mounted on the shaft 36 to slide longitudinally therealong. The linkage that includes the block 48, the rod 46, the lever 44 and the roll 42 translates linear movement of the block 48, represented by the variable x, into deflection of the roller 42 in the direction represented by the arrows 49 to bend the wire 12 into a desired radius.

The coil pitch forming section 50 of the coil forming mechanism 34 includes a pocket 52 formed of a pair of identical parallel plates spaced from each other a distance slightly larger than the thickness of the wire 12. The plates of the pocket 52 are joined at their upper ends and pivotally attached to the device 30 at an axis 54, which is parallel to the shaft 36. The plates of the pocket 52 are also joined and pivotally mounted at their lower ends on an extension 55 of the axis 54 and parallel to the shaft 36. The pocket 52 is thereby rotatable on the axes 54, 55. Rigidly extending from the pocket 52 on the axes 54, 55 is a helical cam 56. A pair of rollers 57 on a block 58, which is slidably mounted on the shaft 36, engage the cam 56 on both sides thereof to rotate the pocket 52 as the block 58 moves axially on the shaft 36 a linear dimension represented by the variable y. The mechanism 50 thereby translates the linear motion of the block 58 in the direction y to rotating motion of the pocket 52, which results in a bending of the wire 12 in the longitudinal direction of the coil 14 of the spring 10 to impart pitch to the coil. The sign of the variable y reflects the direction (left hand or right hand) of the formed coil.

The shape of the spring that is formed by the apparatus 20 is determined by the respective relative motions x and y of the blocks 48 and 58 with respect to the feed z of the wire 12. This motion is controlled by the shapes of cams 59*x* and 59*y*, respectively, which are linked to and driven by a drive mechanism 29 of the wire feeder 22.

In order to avoid the accumulation of torsion or twist and to prevent tangling of the continuous multicoil spring as the direction of the bend of the wire 12 is changed to produce coils of opposite rotational direction or hand by the roller 42, the shaft 36 and all components thereon is rotatable through an angle of 180° by rotation of a chain drive sprocket 60 fixed to the shaft 36, which is driven by a servo motor or other actuator, or by a cam or gear mechanism 61 linked to the drive 29. In the prior art, the coil forming device (FIG. 2) of the Gerstorfer patent is arranged as part of a spring forming apparatus as illustrated in FIG. 3.

Figure 3:
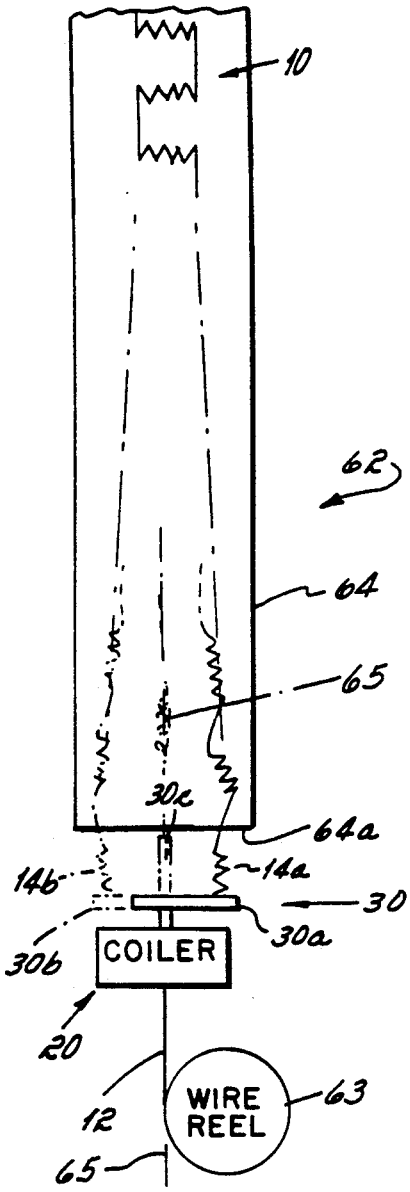
PRIOR ART FIG. 3
FIG. 3 is a plan view of a multiple coil spring forming machine of the prior art using the coil forming apparatus of FIG. 2 to produce a spring such as that of FIG. 1.

In FIG. 3, the coil forming apparatus 62 includes the Gerstorfer coiler 20 being fed wire 12 from a wire reel 63. The coiler 20 is positioned with its forming device 30 arranged in-line with a forming table 64 over which the formed spring 10 is fed. The coiler 20 has its forming device 30 shown in solid lines in a position 30*a* to one side of the center-line or axis 65 to produce coils 14*a* of one direction of rotation, with the device 30 being rotatable 180° to the opposite side of the axis 65 to produce coils of the opposite hand or direction of rotation.

When producing coils 14*b* of opposite rotational direction, the device 30 is rotated first through 90° from position 30*a* to position 30*b* to generate straight connecting section 16 of the continuous spring, and then through another 90° from position 30*b* to position 30*c* in which coils of the opposite rotational direction are produced. The rotation of the device 30 proceeds from position 30*a* to position 30*c*, then to position 30*b*, then back to position 30*c*, and then back to position 30*a*.

The formation of the coils 14*a* and 14*b* require several 360° twists of the formed spring 10 immediately downstream of the forming device 30. The number of twists in one direction are equal to the number of turns of the coils of individual springs 14. Then, when the next coil is being formed, which is of the opposite rotational direction, this twist reverses. At some point sufficiently downstream of the forming device 30, at the exit end of the forming table 64, the twist will be damped out and the continuous spring 10 will advance without torsional motion. During the formation of the straight section 16 of the spring 10, the spring will be fed first to the right and to the left of the forming device 30, transverse to the direction of feed of the formed continuous spring.

The rotation of the device 30 and of the spring 10 at the upstream end of the table 64 limits the speed at which springs can be formed by the apparatus 62 due to the inertia of the device 30 and the centrifugal forces of the rotating spring 10. With the present invention described hereinafter, the rotation of the coil forming head is avoided and the centrifugal forces of the rotating spring significantly reduced, thereby greatly increasing the speed at which the springs can be formed.

Figure 4A:
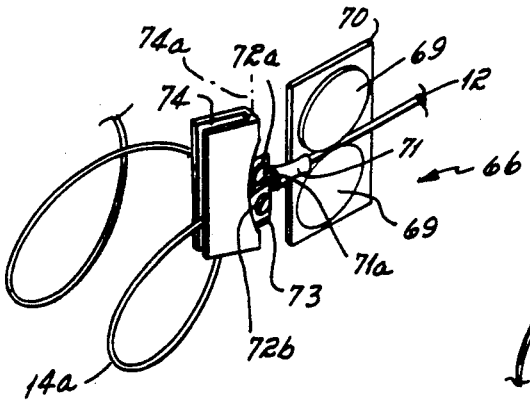
FIGS. 4A through 4C are isometric views illustrating, in three positions, a coil forming apparatus according to one embodiment of the present invention.
Figure 4B:
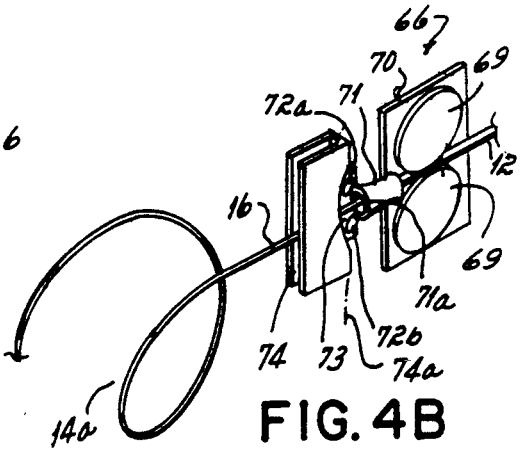
Figure 4C:
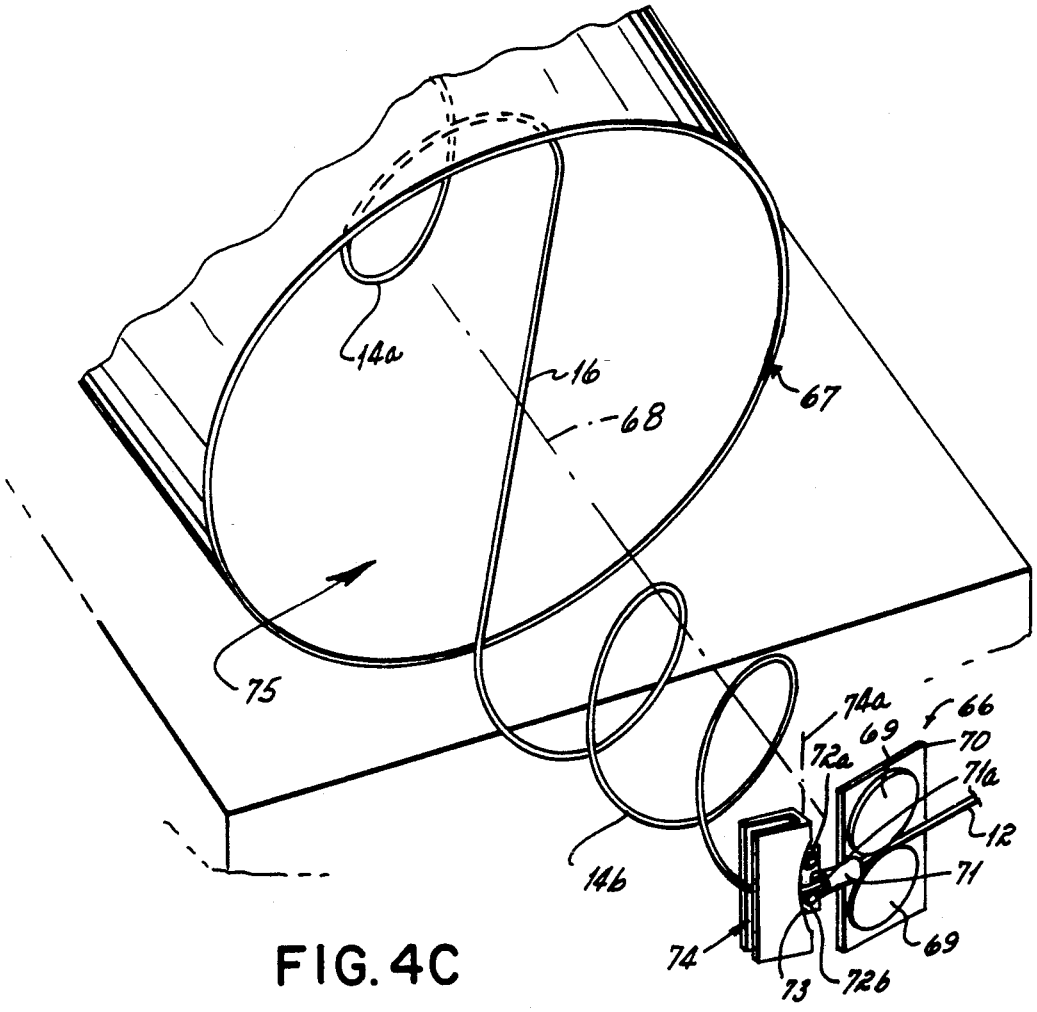
Figure 5:
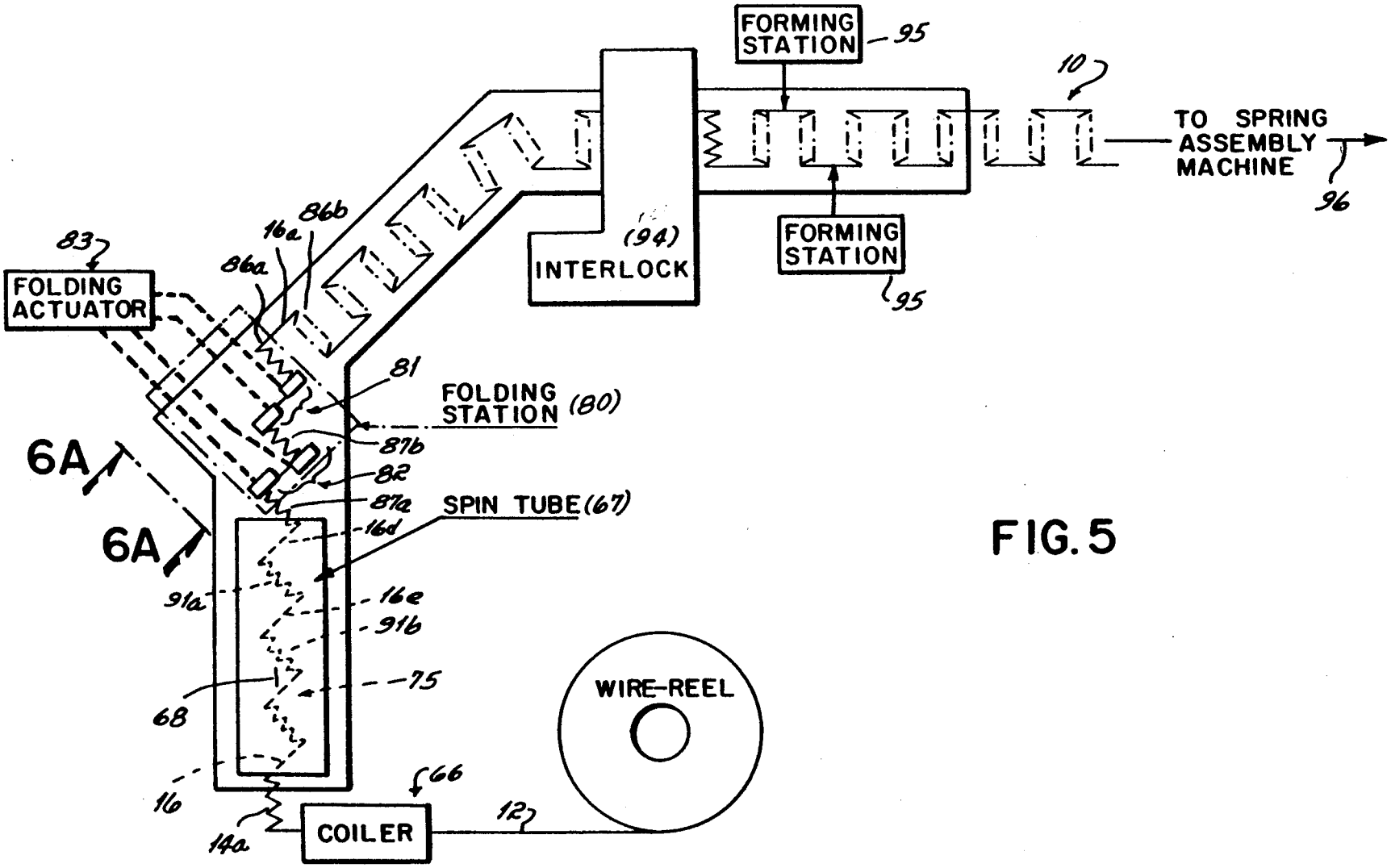
FIG. 5 is a plan view of a multiple coil spring forming machine and process according to principles of the present invention, showing the coil forming apparatus in the position of FIG. 4A.

According to certain of the principles of the present invention, a coil forming apparatus 66 is provided as illustrated in FIGS. 4A through 4C. The coil forming apparatus or coiler 66 is positioned adjacent the entrance end of a spin tube 67 as illustrated in FIG. 5. Referring to FIGS. 4A–4C and FIG. 5, the wire 12, which forms the spring 10, is fed through the coiler 66 transverse to the axis 68 of the spin tube 67, driven by a pair of rotatable feed rolls 69 or other feeding mechanism. The feed rolls 69 are rotatably mounted on a stationery frame plate 70 and rotated by a rotary servo motor (not shown) or other drive unit.

The wire 12 fed from the rolls 69 proceeds through a rigid guide tube 71 having a flared forming end 71*a* against which the wire is bent to a controlled radius by one of a pair of forming rollers 72, which include a roller 72*a* for bending the coil into a left hand coil 14*a* and roller 72*b* for bending the coil into a right hand coil 14*b*. The rollers 72*a* and 72*b* are rotatably mounted on a carrier plate 73, which is slidably mounted with respect to the frame plate 70 so as to move in a direction perpendicular to the direction of feed of the wire 12 and the axis 68 of the spin tube 67.

The pitch of the coils 14*a* and 14*b* is imparted by a pocket or yoke 74 formed of a pair of parallel plates between which the bent wire from the rollers 72*a* and 72*b* passes. The yoke 74 is pivotally mounted on a vertical axis 74*a* which is parallel to the direction of movement of the plate 73 on which the rollers 72 are mounted. The yoke 74 pivots between a position in line with the feed direction of the wire 12 through the feed rolls 69 and a position inclined in the downstream direction of the spin tube 67.

Referring to FIG. 4A, as the wire 12 is fed by the rolls 69 through the guide tube 71, it emerges from the forming end 71*a* to be bent by the roller 72*b*, which is moved downwardly in FIG. 4A by the downward movement of the carrier plate 73 to form a left hand coil 14*a*. The pitch is imparted to this coil by the downstream pivoting of the yoke 74 about its axis 74*a*. When the left hand coil 14*a* has been formed, the carrier plate 73 is centered to move the rollers 72*a*–72*b* out of contact with the wire 12 and the yoke 74 is pivoted to an in-line position as illustrated in FIG. 4B to form the straight section 16 of the spring. Then the plate 73 moves to its upper position to bring the roller 72*b* into contact with the wire 12, whereupon the yoke 74 again pivots to the downstream inclination, as illustrated in FIG. 4C, to form the right hand coil 14*b*.

As can be seen by reference to FIG. 4C, as the coil 14*b* is being formed by the coiler 66, the previously formed left hand coil 14*b*, the straight section 16 and a portion of the entire partially formed length 75 of the spring being formed is rotated about the axis 68 of the spin tube 67. The maximum radius of rotation of the partially formed spring 75 is less than that of the prior art of FIG. 3. Thus, the centrifugal forces which develop with the process of FIG. 5 are less than that with the process of FIG. 3, while the rotation of the forming head 66 of FIGS. 4A–4C and 5 is not required as it is with the forming device 30 of FIGS. 2 and 3. Accordingly, significantly greater speeds are provided with the present invention.

Referring to FIG. 5, the coil forming device 66 is illustrated in the position shown in FIG. 4A, adjacent the inlet of a spin tube 67. The spin tube 67 allows for the alternating twists of the wire caused by the alternating rotation of the coils to cancel so that the spring exiting the spin tube 67 is free of torsion. The coiler 66 forms a continuous partially formed spring length 75 as shown in more detail in FIG. 5 with alternating left and right hand rotational coils 14*a* and 14*b*, respectively, on opposite sides of the interconnecting head 16 which joins the coils 14*a* and 14*b*. As such, the coils 14*a* and 14*b* extend in the generally same direction, inclined at approximately a 45°, along the wire.

From the spin tube 67, the partially formed spring length 75 proceeds downstream to a folding station 80 where it is further formed into the spring 10 of FIG. 1. The folding process results in a natural 45° turn in the downstream path of the spring, however, the spring 10 is sufficiently elastic for the path to remain straight or to bend at some other angle, for example at 90°, which is preferred for compactness of the system. For clarity in the description of the operation of the folding station 80, however, this 90° turn is illustrated as two 45° turns.

The operation of the folding station 80 can be better understood by reference to FIGS. 5A–5D. At the folding station 80, two sets of gripper assemblies 81 and 82, including grippers 81*a*, 81*b* and 82*a*, 82*b*, are provided, to respectively grip and twist the partially formed spring 75 to impart alternating 180° twists to each of the straight sections 16 of the partially formed spring 75 to form it into the spring 10 of FIG. 1. The grippers of the gripper assemblies 81, 82 may be any mechanism which grips, preferably rigidly, the straight sections 16 of the spring so as to impart a twist to it without slippage, so that the imparted twist is restricted to the portion of wire between the two grippers of each of the sets.

In the embodiment illustrated, the gripper assembly 82 is moveable, driven by a piston or other reciprocating drive element included in a gripper drive unit or actuator 83. The gripper 81*b* of the assembly 81 is rotatable through an angle of 180° with respect to the gripper 81*a* so as to rotate a straight section 16 held therebetween to impart a permanent 180° twist to it. Similarly, gripper 82*a* of the assembly 82 is rotatable through an angle of 180° with respect to the gripper 82*b* so as to rotate a straight section 16 held therebetween to also impart a permanent 180° twist to it. Each of the grippers 81 and 82 may include a pair of opposed pliers-type jaws of, for example, the locking type, separately actuatable by the folding actuator 83.

Figure 5A:
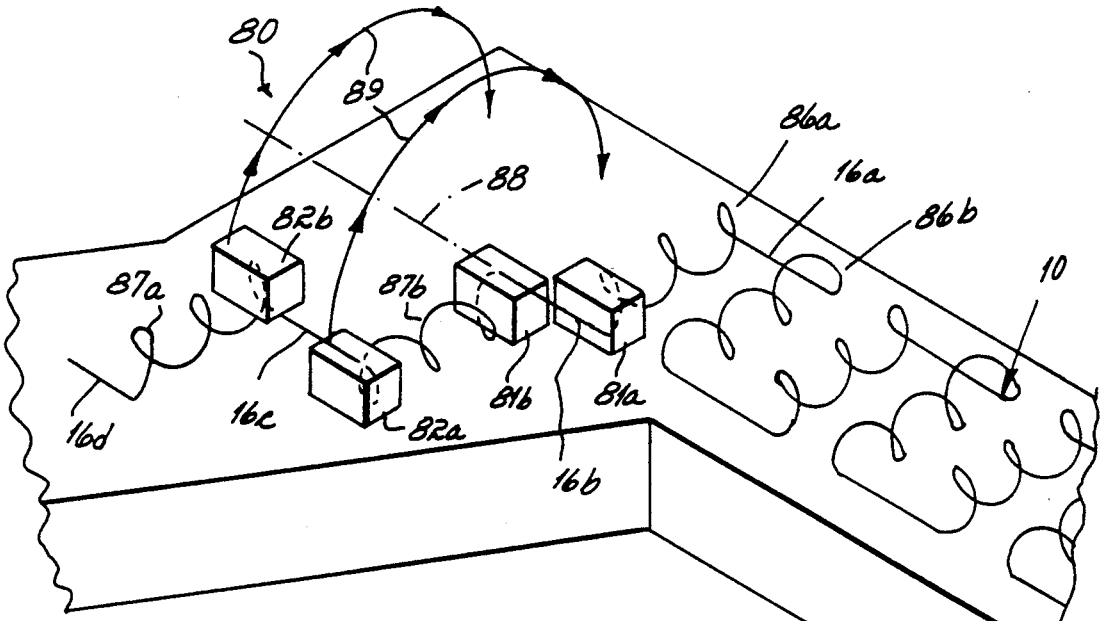
FIG. 5A is an isometric view of the folding station portion of the apparatus of FIG. 5, illustrating the spring and machine elements in the position shown in FIG. 5.

Referring concurrently to FIGS. 5 and 5A, the fully formed spring 10 is illustrated proceeding downstream from the folding station 80. The most recently formed pair of coils 86*a* and 86*b* of the spring 10 comprises the left hand coil 86*a* interconnected by a straight section 16*a* with the right hand coil 86*b*. Immediately upstream of the pair of coils 86*a* and 86*b* is a pair of coils 87*a* and 87*b* of the partially formed portion 75 of the spring, the right hand coil 87*b* of the pair 87*a*, 87*b* is connected at its downstream end by straight section 16*b* to the upstream end of the left hand coil 86*a*, and is interconnected at its upstream end by the straight section 16*c* to the downstream end of the left hand coil 87*a*.

Figure 6A:
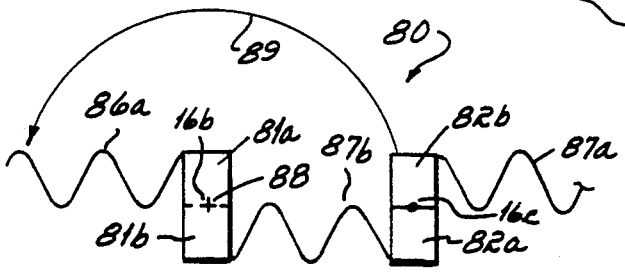
FIG. 6A is a cross-sectional view taken along the line 6A—6A of FIG. 5 illustrating the spring and machine elements in the position of FIGS. 5 and 5A.
Figure 6B:
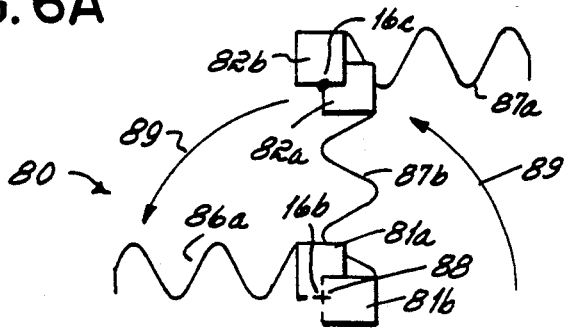
FIG. 6B is a cross-sectional view similar to FIG. 6A illustrating the spring and machine elements in the position of FIG. 5B.

At the folding station 80, the trailing head of a left hand coil 86*a* is gripped by fixed gripper 81*a* while the leading head of a right hand coil 87*b*, on the opposite end of the straight section 16*b*, is gripped by gripper 81*b*. The gripper 81*a*, when gripping the spring, is non-rotational, while the gripper 81*b* is rotatable about a fixed axis 88. At the same time, the trailing head of the right hand coil 87*b* is gripped by gripper 82*a* while the leading head of the next downstream left hand coil 87*a*, on the opposite end of the straight section 16*c*, is gripped by the gripper 82*b*. Both of the grippers 82*a* and 82*b* are moveable in unison along the 180° arcs 89 about the axis 88. During this movement, the gripper 82*a* rotates about the straight section 16*c* while the gripper 82*b* retains its initial orientation. The initial orientation of the grippers 81*a*, 81*b*, 82*a* and 82*b* are illustrated in FIG. 6A.

Figure 5B:
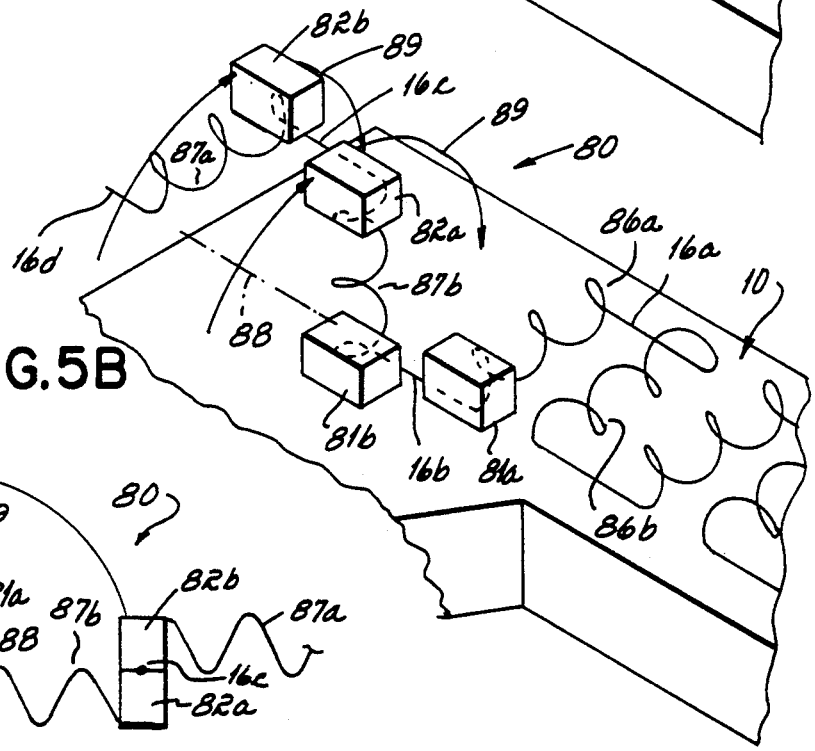
FIGS. 5B through 5C are isometric views similar to FIG. 5A illustrating the spring and machine elements in three different positions during the folding cycle.
Figure 5C:
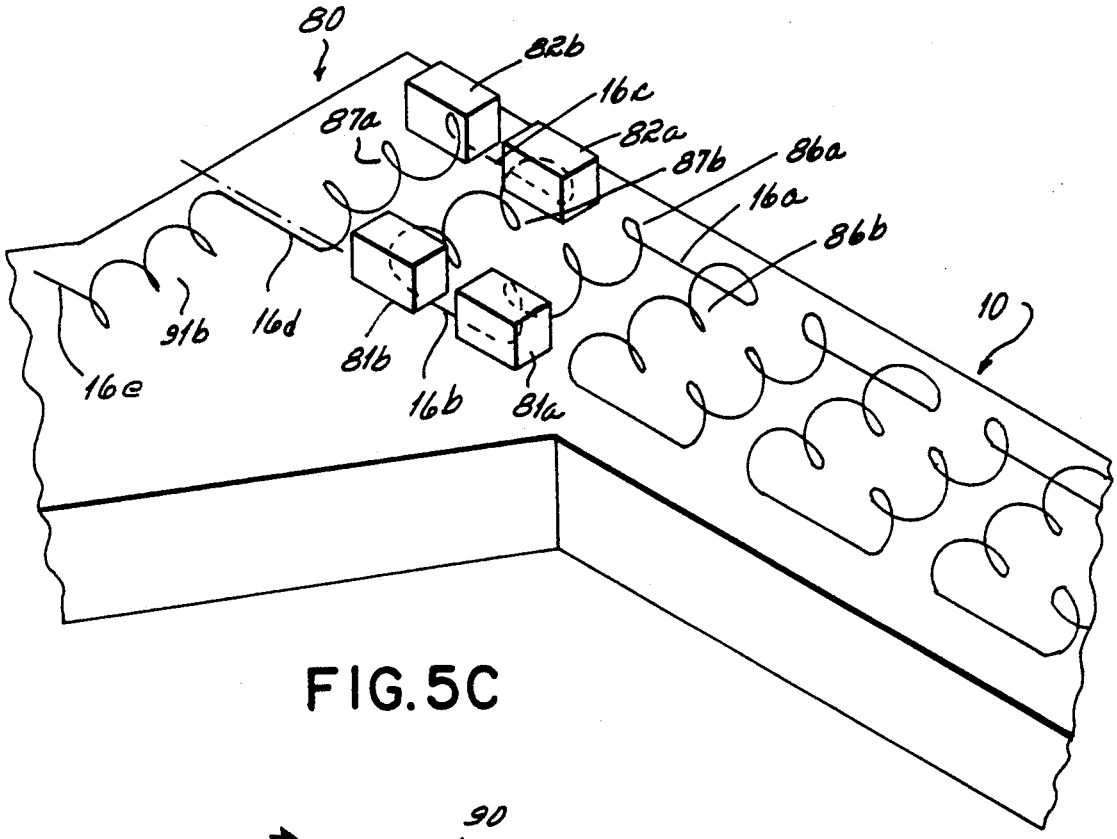
Figure 5D:
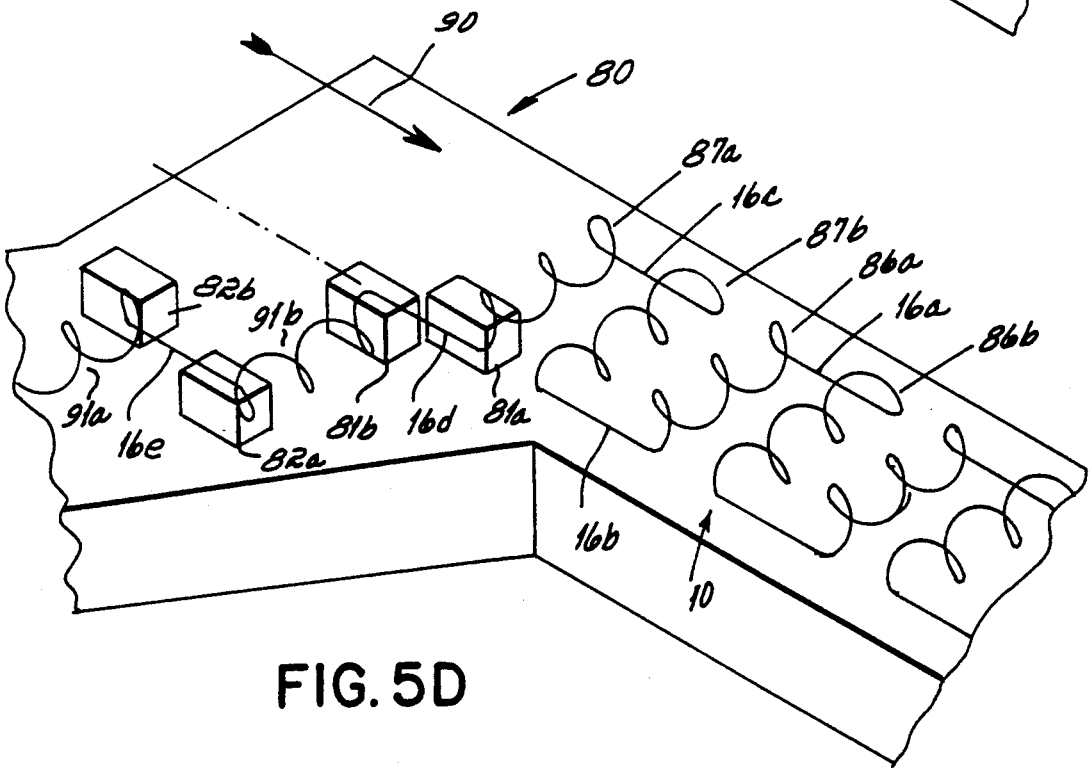

Referring to FIG. 5B, the grippers 82*a* and 82*b* are shown as having moved through 90° of the arc 89. The grippers 81*b* and 82*a* have rotated 90°, and opposite 90° twists have been imparted to the straight sections 16*b* and 16*c* between the respective gripper pairs 81*a*, 81*b* and 82*a*, 82*b*. FIG 5C shows these elements having been rotated through an additional 90°. The total rotation or twisting of 180° will actually be somewhat greater than 180° to overcome the elastic deformation and to impart 180° of plastic or permanent deformation to the straight sections 16*b* and 16*c*. This motion brings the next straight section 16*d* in line with the axis 88 and advances the next upstream coils toward the forming station. When this occurs, the grippers 81*a*, 81*b* and 82*a*, 82*b* release the wire allowing the formed spring 10 to move downstream from the forming station 80 in the direction of the arrow 90 in FIG. 5D. Then the grippers 81*a*, 81*b* and 82*a*, 82*b* engage the next two pair of spring heads, those joined by the straight sections 16*d* and 16*e*, and the cycle proceeds as described in connection with FIGS. 5A through 5C above to form the next pair of coils 91*a* and 91*b*.

Referring again to FIG. 5, after the spring is formed at the folding station 80, the formed spring 10 proceeds downstream to an interlock station 94, additional forming stations 95, a take-up reel or, preferably, directly into a spring assembly machine (not shown) as represented by arrow 96. A common interlock station 94 and additional forming station 95, together with a take-up reel for accumulating the formed spring, and typical downstream forming bending operations, are fully disclosed and described in British Patent No. 1,104,884 and U.S. Pat. No. 4,886,249, expressly incorporated herein by reference.

Because the method and apparatus of the present invention operates with much greater speed than the prior art, it may not be necessary to coil the continuous formed spring into rolls before feeding the spring into an assembly machine. Instead, the formed continuous springs may be fed directly into the assembly machine from one or two coilers. This manufacturing technique has its additional advantages of enabling assembly problems caused by incorrectly formed springs to be quickly corrected rather than being allowed to accumulate in the rolls which may later have to be discarded because of the inability of the assembly machine to accommodate those incorrectly formed springs.

Having described the invention, the following is claimed:

1. A method of manufacturing a multiple coil spring having coils and coil interconnecting heads alternately formed of a continuous wire, the coils being approximately parallel to each other and of alternating rotation and direction, alternate ones of the coil heads lying on different sides of the spring with the coils extending transversely therebetween and approximately perpendicular thereto, the method comprising the steps of:

(a) forming the wire into a coil of a first rotation and extending in a first direction; then (b) forming the wire upstream of and adjacent to the formed coil of first rotation into an interconnecting head extending in a second direction approximately perpendicular to the first direction;

(c) forming the wire upstream of and adjacent to the formed interconnecting head into a coil of a second rotation opposite the first rotation and extending in approximately the same first direction of step (a); then (d) forming the wire upstream of and adjacent to the formed coil of second rotation into an interconnecting head extending in approximately the second direction; then (e) repeating steps (a) through (d) to form a partially formed continuous step-shaped spring of coils of alternating opposite rotation extending in approximately the same direction and interconnected by heads extending in approximately the same direction approximately perpendicular to the direction of the coils;

(f) oppositely twisting a pair of consecutive ones of the formed coil interconnecting heads each approximately 180° thereabout to reverse the direction of the coil therebetween and to bring the upstream one of the heads being twisted into approximate alignment, on the same side of the spring being manufactured, with the next head downstream of the pair being twisted, and to bring the next head upstream of the pair being twisted into approximate alignment, on the other side of the spring being manufactured, with the downstream one of the heads being twisted; and, then (g) repeating step (f) on the next upstream pair of consecutive ones of the formed coil interconnecting heads.

2. The method of claim 1 wherein each of the forming steps (a) through (d) includes the substep of feeding unformed wire in approximately the second direction.

3. The method of claim 2 wherein the coil forming steps (a) and (c) each further include the substep of bending the wire in a third direction approximately perpendicular to the first and second directions to form a coil.

4. The method of claim 2 wherein coil forming steps (a) each further include the substep of bending the wire in a third direction approximately perpendicular to the first and second directions to form a coil of the first rotation and coil forming steps (c) each further include the substep of bending the wire in a direction opposite the third direction to form coils of the second rotation.

5. The method of claim 4 wherein coil forming steps (a) and (c) each further include the substep of bending the wire in approximately the first direction to impart pitch to the coils.

6. A method of manufacturing a multiple coil spring having coils and coil interconnecting heads alternatively formed of a continuous wire, the method comprising the steps of:

forming the wire into a coil extending in a first direction;

forming the wire upstream of and adjacent to the formed coil into an interconnecting head extending in a second direction;

repeating the coil and head forming steps to form a partially formed continuous step-shaped spring of coils extending in approximately the same direction and interconnected by heads extending in approximately the same direction;

then oppositely folding the partially formed spring about axes generally parallel to the interconnecting heads of a pair of consecutive ones of the formed coil interconnecting heads to reverse the direction of the coil therebetween; and, repeating the folding step on the next upstream air of consecutive ones of the formed coil interconnecting heads.

7. The method of claim 6 wherein the second direction is approximately perpendicular to the first direction.

8. The method of claim 7 wherein the interconnecting heads of the partially formed spring extend in approximately a direction approximately perpendicular to the direction of the coils.

9. The method of claim 6 the folding step includes the substep of oppositely twisting a pair of consecutive ones of the formed coil interconnecting heads to reverse the direction of the coil therebetween.

10. The method of claim 6 the folding step includes the substep of approximately aligning the upstream one of the heads being twisted, on the same side of the spring being manufactured, with the next head downstream of the pair being twisted, and to approximately aligning the next head upstream of the pair being twisted, on the other side of the spring being manufactured, with the downstream one of the heads being twisted.

11. The method of claim 6 wherein the coil and head forming steps each includes the substep of feeding unformed wire in a direction approximately perpendicular to the first direction.

12. The method of claim 11 wherein the coil forming step further includes the substep of bending the wire in a third direction approximately perpendicular to the first direction to form a coil.

13. The method of claim 11 wherein coil forming step further includes the substep of bending the wire in approximately the first direction to impart pitch to the coils.

* * * * *